US008113176B2

(12) United States Patent
Rossignol et al.

(10) Patent No.: US 8,113,176 B2
(45) Date of Patent: Feb. 14, 2012

(54) INJECTOR WITH AXIAL-PRESSURE COMPENSATED CONTROL VALVE

(75) Inventors: Francois Rossignol, Mornant (FR); Stephan Amelang, Koenigsbach-Stein (DE); Friedrich Howey, Ditzingen (DE); Olivier Charvet, Saint Laurent de Mure (FR); Tony Dumont, Villeurbanne (FR)

(73) Assignee: Robert Bosch GmbH, Stuttgart (DE)

( * ) Notice: Subject to any disclaimer, the term of this patent is extended or adjusted under 35 U.S.C. 154(b) by 299 days.

(21) Appl. No.: 12/447,322

(22) PCT Filed: Aug. 29, 2007

(86) PCT No.: PCT/EP2007/058968

§ 371 (c)(1), (2), (4) Date: Apr. 27, 2009

(87) PCT Pub. No.: WO2008/049669

PCT Pub. Date: May 2, 2008

(65) Prior Publication Data

US 2010/0071665 A1 Mar. 25, 2010

(30) Foreign Application Priority Data

Oct. 25, 2006 (DE) ..... 10 2006 050 163

(51) Int. Cl.
*F02M 59/46* (2006.01)
*F02M 59/48* (2006.01)

(52) U.S. Cl. ..... 123/467; 123/468

(58) Field of Classification Search ..... 123/467, 123/468, 470, 456, 490, 499; 239/88–96, 239/533.9

See application file for complete search history.

(56) References Cited

U.S. PATENT DOCUMENTS

| | | | | |
|---|---|---|---|---|
| 5,779,149 | A * | 7/1998 | Hayes, Jr. | 239/124 |
| 6,409,094 | B2 * | 6/2002 | Tojo et al. | 239/5 |
| 2001/0022320 | A1 * | 9/2001 | Tojo et al. | 239/5 |
| 2006/0000453 | A1 | 1/2006 | Ricco et al. | |
| 2007/0170286 | A1 | 7/2007 | Boecking | |
| 2007/0205302 | A1 | 9/2007 | Ricco et al. | |
| 2009/0308354 | A1 * | 12/2009 | Eisenmenger | 123/476 |

FOREIGN PATENT DOCUMENTS

| | | | |
|---|---|---|---|
| DE | 10120157 | A1 | 11/2002 |
| DE | 10353169 | A1 | 6/2005 |
| EP | 1612403 | A1 | 1/2006 |

* cited by examiner

*Primary Examiner* — Mahmoud Gimie
(74) *Attorney, Agent, or Firm* — Ronald E. Greigg

(57) ABSTRACT

The invention relates to an injector for injecting fuel into combustion chambers. According to the invention, a valve piston of a control valve is provided with low pressure on both faces thereof. The valve piston is arranged in a valve chamber hydraulically connected to a control chamber and is guided inside a sleeve received in the valve chamber. The valve chamber contains a spring supported on one end against the sleeve and on the other end on the valve piston such that the spring presses the valve piston onto a valve seat and the sleeve onto an opposing bottom surface. The valve piston diameter inside the sleeve corresponds to the effective valve piston diameter at the valve seat.

20 Claims, 2 Drawing Sheets

INJECTOR WITH AXIAL-PRESSURE COMPENSATED CONTROL VALVE

CROSS-REFERENCE TO RELATED APPLICATION

This application is a 35 USC 371 application of PCT/EP 2007/058968 filed on Aug. 29, 2007.

BACKGROUND OF THE INVENTION

1. Field of the Invention

The invention relates to an injector for injecting fuel into combustion chambers.

2. Description of the Prior Art

German Patent Disclosure DE 103 53 169 A1 describes a common-rail injector having a control valve for blocking and opening a fuel outflow course from a control chamber. For actuating the control valve, a piezoelectric actuator is provided, which acts in an adjusting fashion in the axial direction on a valve piston via a boosting piston. By means of the control valve, embodied as a 3/2-way valve, the fuel pressure inside a control chamber can be varied, and the control chamber is supplied with fuel from a high-pressure fuel reservoir via a pressure conduit having both an inlet throttle restriction and an additional conduit. By varying the fuel pressure inside the control chamber, a nozzle needle is adjusted between an open position and a closed position, and in its open position, the nozzle needle opens up the fuel flow into the combustion chamber of an internal combustion engine. Since the known control valve is not pressure-compensated in the axial direction, high adjusting forces are needed for opening the control valve.

From European Patent Disclosure EP 1 612 403 A1, a common-rail injector with a control valve that is pressure-compensated in the axial direction is known. The known control valve has, as its adjustable valve element, an axially displaceable sleeve that is subjected solely in the radial direction to fuel pressure from a high-pressure region. Because of the use of a pressure-compensated control valve, only slight adjusting forces are needed for opening the control valve, so that the adjusting task in the known injector is performed by an electromagnetic drive mechanism. If the control valve known from EP 1 612 403 A1 were adopted for the injector known from DE 103 53 169 A1, then the entire configuration of the injector would have to be changed. In particular, in the piezoelectric-actuator-driven injector, the low-pressure chamber would have to be shifted substantially farther in the direction toward the control chamber.

OBJECT AND SUMMARY OF THE INVENTION

The object of the invention is therefore to propose an injector with an alternatively embodied axial-pressure-compensated valve, which is especially suitable for the use of an electromagnetic actuator.

The fundamental concept of the invention is, instead of an axially adjustable sleeve, to provide an axially adjustable valve piston for opening and closing the control valve. The valve piston (bolt) is disposed inside a valve chamber that communicates hydraulically with the control chamber, so that when the control valve is open, fuel can flow out through a fuel outflow course from the control chamber via the valve chamber to a low-pressure chamber. When the control valve is closed, the fuel outflow course is blocked. According to the invention, the valve piston is not guided directly in a throttle plate but rather in a sleeve that is received in the valve chamber. In order to prestress the valve piston in the closing direction onto a valve seat and simultaneously to prevent the sleeve from lifting from a bottom face (sealing face) of the valve chamber, a spring is provided, which is braced on one end on the valve piston, in particular on the underside of a valve head, and on the other on the sleeve, in particular on the end face of the sleeve. So that no or only minimal pressure forces will act in the axial direction on the valve piston, or in other words so that the control valve is pressure-compensated in the axial direction, it is provided that low pressure is applied to both face ends of the valve piston, and that the (projection) faces of the valve piston subjected to low pressure in the axial direction are the same size on both sides. Since the face end of the valve piston oriented toward the valve seat defines the low-pressure chamber or communicates hydraulically with it, low pressure automatically prevails at the end face. Subjecting the (lower) face end, diametrically opposite the (upper) face end, to low pressure can be attained for instance by providing that a connecting conduit extends to the face end, remote from the valve seat, of the valve piston and hydraulically connects the region adjacent to this face end to the low-pressure region of the injector. In the low-pressure region, especially in the low-pressure chamber, of the injector, fuel pressures in a range between approximately 0 and 10 bar prevail, depending on the operating state, while conversely the fuel flowing from a high-pressure fuel reservoir into the injector is at a pressure in a range between approximately 1800 and 2000 bar. The embodiment according to the invention of the injector valve can be adopted without problems for the injector construction known from DE 103 53 169 A1; in that case, preferably instead of an additional fuel supply to the valve chamber, a low-pressure connecting line can be provided, in order to supply the face end of the valve body, oriented toward the nozzle needle, with low pressure. In particular, although this is not compulsory, an electromagnetic drive mechanism may be used instead of a piezoelectric actuator.

In a refinement of the invention, it is advantageously provided that the sleeve is received with radial play in the valve chamber, so that fuel under pressure in the valve chamber exerts a radially inward-acting force on the sleeve, thus avoiding widening of the guide play between the sleeve and the valve piston during operation and thus minimizing leakage losses.

In a feature of the invention, it is advantageously provided that the hydraulic communication between the control chamber and the valve chamber is attained via an outflow conduit with an outflow throttle restriction; the cross sections of the outflow throttle restriction and of the inflow throttle restriction, disposed in the pressure conduit that supplies the control chamber, are adapted to one another in such a way that with the control valve open, a net fuel outflow into the low-pressure chamber results. Preferably, the outflow conduit discharges into the valve chamber in a region between the sleeve and the inner wall of the valve chamber. As a result, it is possible for the outflow conduit to be integrated solely with a throttle plate disposed between the control chamber and the valve chamber.

As already mentioned, the injector is especially suitable for the use of an electromagnetic actuator, since because of the axial pressure equilibrium of the control valve, only comparatively slight adjusting forces have to be exerted. The electromagnetic drive mechanism has at least one electromagnet (coil) and at least one armature plate cooperating with it, and the armature plate must be operatively connected to the valve piston. Since in the case of an electromagnetic drive mechanism there is no need for a minimum pressure to be present for acting on a booster piston of a piezoelectric actuator, the low-pressure level can be made lower, and thus the overall return system for the fuel can be designed more economically.

In particular, the armature plate is operatively connected to a pressure rod, for instance being embodied in one piece with it, and the free end of the pressure rod, remote from the armature plate, is centered on the valve piston, in particular the valve piston head. As a result, the adjusting force of the electromagnetic drive mechanism can be transmitted via the armature plate and from there via the pressure rod to the valve piston in order to lift the valve piston from the valve seat and thus open the fuel outflow course to the low-pressure chamber, and in turn as a result, the nozzle needle lifts from its needle seat and opens up the fuel flow into a combustion chamber.

The stroke length of the electromagnetic drive mechanism can be adjusted by varying the length of the pressure rod.

To attain the centering of the pressure rod on the face of the valve piston, a concave-convex pairing between the valve piston and the pressure rod is advantageously attained, and preferably the pressure rod is embodied as convex in the region of its free end, while the end face of the valve piston is embodied as correspondingly concave.

To assure contacting of the armature plate, pressure rod and valve piston even when the electromagnetic drive mechanism is not being supplied with current, a weak prestressing spring is preferably provided, which prestresses the armature plate and thus the pressure rod in the direction of the valve piston. However, the spring force must be dimensioned such that it is less than the spring force of the spring inside the valve chamber that presses the valve piston into its valve seat in the opposite direction.

To assure adequate coaxiality in the adjusting motion, it is provided in a refinement of the invention that the pressure rod is guided inside a stop sleeve, and the stop sleeve is received inside the electromagnet of the electromagnetic drive mechanism and has a stop face for the armature plate.

In a feature of the invention, it is advantageously provided that the valve chamber is defined, on its side toward the control chamber, by a throttle plate, and thus the throttle plate forms the valve chamber bottom face on which the guide sleeve is braced inside the valve chamber. The outflow conduit with an outflow throttle restriction out of the control chamber is advantageously also made in this throttle plate.

Additionally, there is advantageously a connecting conduit inside the throttle plate; it connects the face end of the valve piston, toward the nozzle needle, with the low-pressure region of the injector, so that preferably at least approximately the same (low) pressure prevails on both face ends of the valve piston.

BRIEF DESCRIPTION OF THE DRAWINGS

Further advantages, characteristics and details of the invention will become apparent from the ensuing description of preferred exemplary embodiments and from the drawings, in which.

DESCRIPTION OF THE PREFERRED EMBODIMENTS

Figure 1:
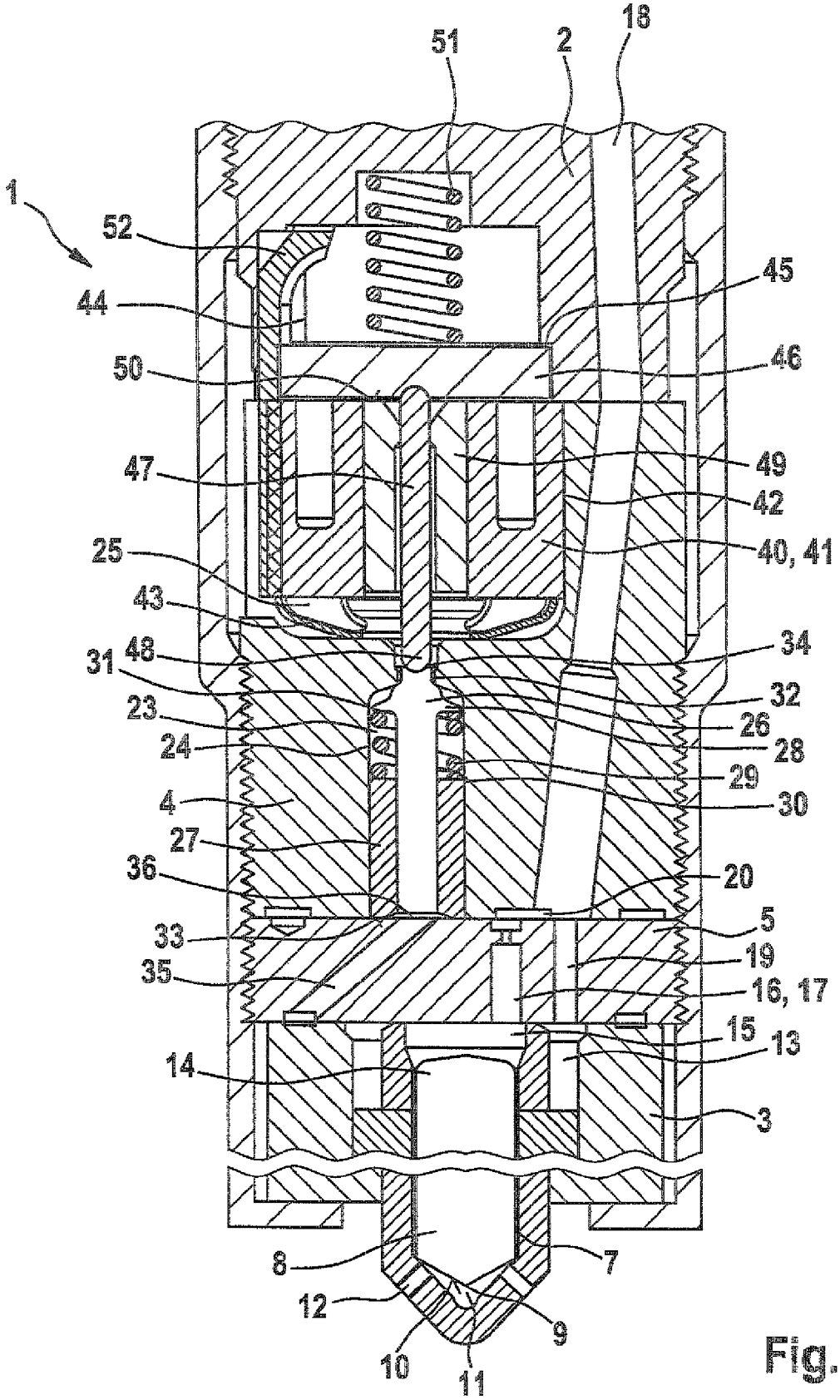
FIG. 1 shows a fragmentary sectional view of an injector with a control valve that is pressure-compensated in the axial direction.

In the drawings, identical components and components with the same function are identified by the same reference numerals.

Figure 2:
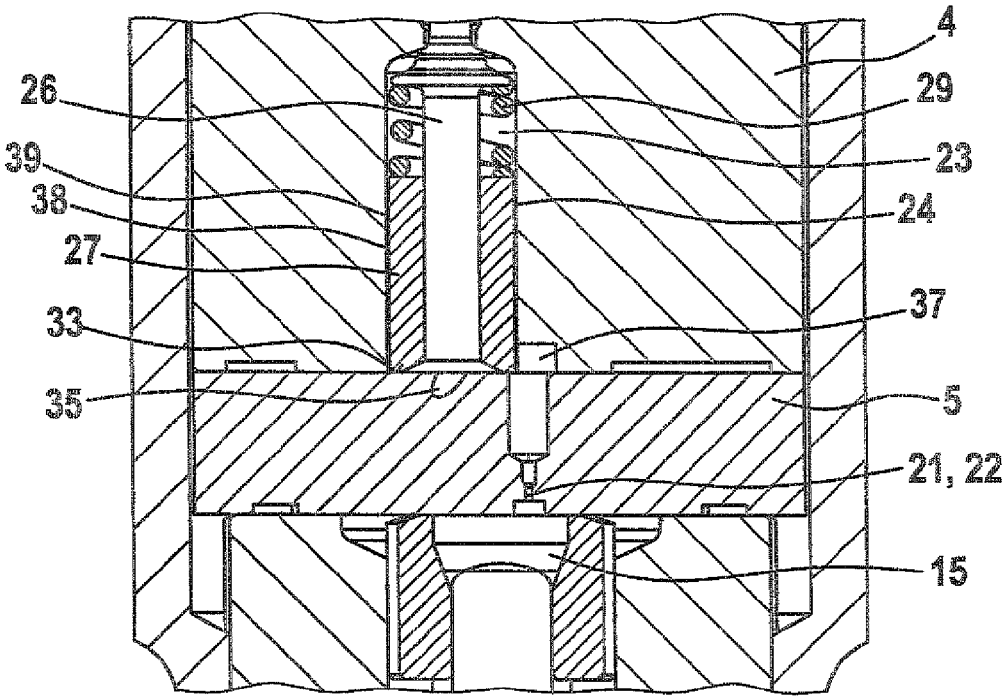
FIG. 2 is a detail of an injector from which the hydraulic communication between the control chamber and the valve chamber can be seen.

In FIGS. 1 and 2, a common-rail injector 1 is shown. The injector 1 has an injector body 2, a nozzle body 3 shown only in parts, as well as a valve body 4 resting on the injector body 2 and a throttle plate 5 disposed between the valve body 4 and the nozzle body 3. A nozzle lock nut (not enumerated) screwed to the injector body 2 and penetrated in the axial direction by the nozzle body 3 generates an axial prestressing force, which braces the nozzle body 3, throttle plate 5, valve body 4 and injector body 2 against one another.

Embodied inside the nozzle body 3 is a guide bore 7, in which an elongated nozzle needle 8 is guided axially movably. At a needle tip 9, the nozzle needle has a closing face 10, with which it can be brought into tight contact with a needle seat 11 embodied inside the nozzle body 3.

When the nozzle needle 8 is resting on the needle seat 11, or in other words is in a closed position, the emergence of fuel from a nozzle hole arrangement 12 is blocked. Conversely, if the nozzle needle is lifted from the needle seat 11, fuel can flow out of a pressure chamber 13 in the axial direction along the nozzle needle 8, past the needle seat 11, to the nozzle hole arrangement 12, where it can be injected, essentially under the high pressure (rail pressure), into a combustion chamber.

The nozzle needle 8 is prestressed in the direction of its closing position by means of a prestressing spring, not shown.

The upper face end 14 of the nozzle needle 8 protrudes into a control chamber 15, which is defined on the side diametrically opposite the face end 14 by the throttle plate 14. Via a pressure conduit 16 with an inflow throttle restriction 17 and via a connecting pocket 20 in the valve body 4, the control chamber 15 is supplied with fuel at high pressure from a supply conduit 18; the supply conduit 18 communicates with a high-pressure fuel reservoir, not shown, which is subjected to pressure for instance via a radial piston pump. The supply conduit 18 communicates simultaneously, via a connecting bore 19 inside the throttle plate 5, with the pressure chamber 13 radially surrounding the control chamber 15. Via an outflow conduit 21, visible in FIG. 2, with an outflow throttle restriction 22 inside the throttle plate 5, the control chamber 15 communicates hydraulically with a valve chamber 23 of a control valve 24 inside the valve body 4. The outflow conduit 21 is part of a fuel outflow course from the control chamber 15 to a low-pressure chamber 25, disposed above the valve chamber 23 in the plane of the drawing. From there, the fuel can flow out via a return line, not shown.

As noted, by means of a prestressing spring, not shown, a closing force is exerted on the nozzle needle 8; simultaneously, by the fuel pressure prevailing in the control chamber 15, a closing force is exerted on the end face 14 of the nozzle needle 8. These closing forces counteract an opening force that arises because of the action of fuel pressure on a stepped face, not shown, embodied on the nozzle needle 8. If the control valve 24 is in a closed position and if the fuel outflow from the control chamber 15 into the low-pressure chamber 25 is blocked, then in the steady state, the closing force acting on the nozzle needle 8 is greater than the opening force, and therefore the nozzle needle 8 assumes its closing position then. If the control valve 24 then opens, fuel flows out of the control chamber, and the nozzle needle 8 is lifted from its needle seat 11.

The flow cross sections of the inflow throttle restriction 17 and outflow throttle restriction 22 are adapted to one another in such a way that the inflow through the pressure conduit 16 is less than the outflow through the outflow conduit 21, and accordingly, there is a resultant net outflow of fuel when the control valve 24 is open. The ensuing pressure drop in the control chamber 15 causes the amount of the closing force to drop below the amount of the opening force and causes the nozzle needle 8 to lift from the needle seat 11.

Inside the valve chamber 23, an axially displaceable valve piston 26 is disposed, which is guided in a sleeve 27 with the least possible guidance play. The sleeve 27 is received with radial play inside the valve chamber 23. Axially between the sleeve 27 and a valve piston head 28, there is a helical spring 29, which is braced on one end on an upper end face 30 of the sleeve 27 and on the other end on a lower annular shoulder 31 of the valve piston head 28 and thus prestresses the valve piston 26 upward, in the plane of the drawing, in the direction of the low-pressure chamber 25 onto a valve seat 32. Simultaneously, the sleeve 27 is pressed sealingly against a bottom face 33 of the valve chamber 23, the bottom face 33 being formed by a surface of the throttle plate 5. The cross-sectional area of the valve piston 26 that is sealed off at the valve seat 32 is equivalent to the cross-sectional area of the valve piston 26 that is guided inside the sleeve 27. In other words, the diameter of the valve seat 32 is equivalent to the inside diameter of the sleeve 27. With its upper face end face 34 in the plane of the drawing, the valve piston 26 protrudes into the region of the low-pressure chamber 25. Via a connecting conduit 35 inside the throttle plate 5, the chamber 36 below the valve piston 26 in the plane of the drawing is connected to the low-pressure region of the injector 1. In particular, a vertical bore, not shown, inside the throttle plate 5 and the valve body 4 leads to the low-pressure chamber 25 or directly to a return line, not shown, to which the low-pressure chamber 25 is also connected. Thus the same (low) pressure prevails on both face ends of the valve piston 26. Because of the at least approximate identity of the areas of the valve piston that are acted upon by low pressure, the valve piston is pressure-compensated in the axial direction.

As can be seen from FIG. 2, from the control chamber 15, the outflow conduit 21 discharges into a pocket 37 in the valve body 4. The pocket 37 communicates with an annular chamber 38 between the sleeve 27 and the valve chamber wall 39, so that fuel from the control chamber 15 can flow into the valve chamber 23. The annular chamber 38 assures that the guidance play between the valve piston 26 and the sleeve 27 does not widen, so that leakage losses are minimized. At the same time, the fuel pressure inside the valve chamber 23 assures that in addition to the axial spring force of the helical spring 29, an axial force acts on the sleeve 27 in the direction of the throttle plate 5, so that the sleeve 27 rests sealingly on the bottom face 33. Any leakage losses are carried away via the connecting conduit 35.

In the upper part, in the plane of the drawing, of the valve body 4, there is an electromagnetic actuator 40 with an electromagnet 41. The electromagnet 41 is received in a bore 42 that guides the electromagnet 41 by way of its inside diameter. The electromagnet 41 is prestressed axially against the lower side of the injector body 2 in the plane of the drawing via a spring element 43. Inside the injector body 2, a stepped bore 44 is provided, whose axis of symmetry corresponds to the axis of symmetry of the valve piston 26. A first step 45 of the stepped bore 44 limits the axial movability of an armature plate 46, which cooperates with the electromagnet 41. A pressure rod 47, which transmits a motion of the armature plate 46 to the valve piston 26 and thus controls the motion of the valve piston 26, is braced centrally on the armature plate 46, or in a receiving bore in the armature plate 46. The pressure rod 47 is centered, with its convex free end 48, on the concave end face 34 of the valve piston 26. The pressure rod 47 is guided in a stop sleeve 49 near the armature plate 46, and the stop sleeve 49 is received in a central through opening in the electromagnet 41. On its upper face end the stop sleeve 49 has a stop face 50 for contact of the armature plate 46 when current is supplied to the electromagnet 41. The armature plate 46, via a weak prestressing spring 51 that is braced on the injector body 2, is pressed via the pressure rod 47 against the valve piston 26, so that these parts are in contact with one another. The contacting of the electromagnet 41 is guided via a housing part 52 into the upper injector body in the plane of the drawing, in order to enable guiding the contacting with the plug, not shown, on the injector head, not shown.

When current is supplied to the electromagnet 41, a tensile force that is greater than the difference between the spring forces of the springs 29 and 51 is exerted between the armature plate 46 and the electromagnet 41. As a result, the armature plate 46 moves downward in the plane of the drawing until it meets the stop face 50 of the stop sleeve 49. In the process, the control valve 24 is opened by lifting of the valve piston 26 from the valve seat 32, so that the fuel outflow course from the control chamber 15 to the low-pressure chamber 25 is opened up.

Figure 3:
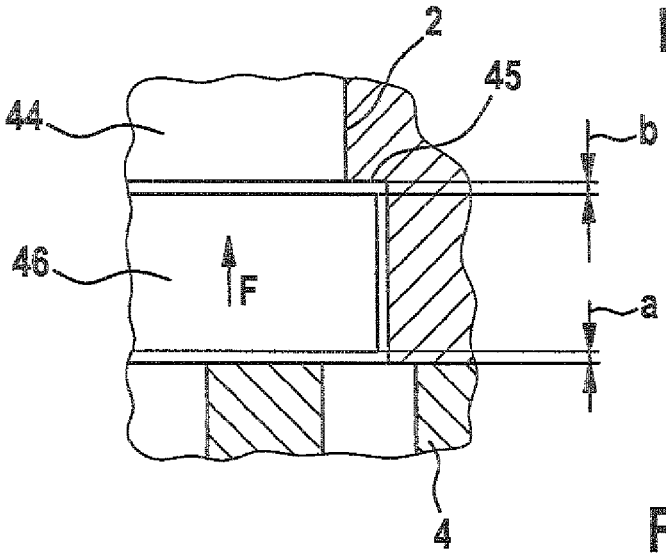
FIG. 3 is an enlarged detail of the installed situation of an armature plate of an electromagnetic drive mechanism of the injector.

In FIG. 3, the installed situation of the armature plate 46 is shown. The armature plate 46 is received between the injector body 2 and the valve body 4. The spacing a between the valve body 4 and the underside of the armature plate 46 is the armature stroke when current is supplied to the electromagnet 41. The spacing b between the top of the armature plate 46 and the injector body 2 is the so-called overstroke. Since the pressure rod 47 and the armature plate 46, at the instant of closing, still have kinetic energy, they are moved onward in the flight direction F, until the armature plate 46 strikes the first step 45 of the stepped bore 44. This additional flight distance is called the overstroke b and should be designed to be as slight as possible, so as to put the control valve into a state of repose as soon as possible after an actuation.

Figure 4:
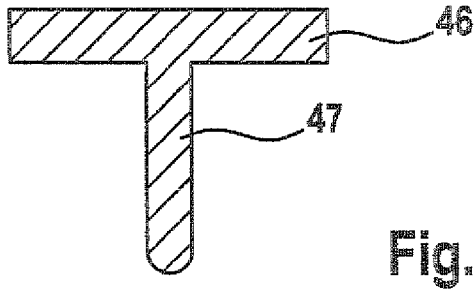
FIG. 4 shows a one-piece structural unit comprising the armature plate and the pressure rod.

FIG. 4 shows a one-piece embodiment between of the armature plate 46 and the pressure rod 47. In that case, the armature stroke can be adjusted by an intentional grinding down of the length of the pressure rod 47.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into combustion chambers of internal combustion engines, in particular a common-rail injector, comprising:

a control valve having a valve piston which is adjustable in an axial direction by an actuator so that a fuel outflow conduit leading out of a control chamber to a low-pressure chamber is opened or blocked, and by opening and blocking the fuel outflow conduit, pressure in the control chamber, which is supplied with fuel via a pressure conduit, is varied, and as a result a nozzle needle operatively connected to the control chamber is adjustable between an open position which opens up a fuel flow and a closed position, wherein the valve piston has opposed face ends upon which low pressure prevails, the valve piston being disposed in a valve chamber communicating hydraulically with the control chamber, wherein a sleeve is provided in the valve chamber which surrounds the valve piston and guides the valve piston in the axial direction, wherein a spring having opposing ends is provided in the valve chamber between the sleeve and the valve piston, the spring being braced at one end on an end face of the sleeve and at the other end on the valve piston, wherein the spring presses the valve piston onto a valve seat and presses the sleeve onto a diametrically opposed bottom face of the valve chamber formed by a surface of a throttle plate, and wherein a diameter of the valve piston inside the sleeve is equivalent to the effective diameter of the valve piston at the valve seat.

2. The injector as defined by claim 1, wherein the sleeve is received with radial play in the valve chamber.

3. The injector as defined by claim 2, wherein the control chamber communicates with the valve chamber via an outflow conduit with an outflow throttle restriction, the outflow conduit discharging into the valve chamber into a region between a valve chamber inner wall and the sleeve.

4. The injector as defined by claim 1, wherein the actuator is an electromagnetic drive mechanism having at least one electromagnet and having at least one armature plate cooperating with the electromagnet.

5. The injector as defined by claim 2, wherein the actuator is an electromagnetic drive mechanism having at least one electromagnet and having at least one armature plate cooperating with the electromagnet.

6. The injector as defined by claim 3, wherein the actuator is an electromagnetic drive mechanism having at least one electromagnet and having at least one armature plate cooperating with the electromagnet.

7. The injector as defined by claim 4, further includes a pressure rod having opposing ends, wherein the armature plate is operatively connected to the pressure rod at one end, and the other end of the pressure rod, remote from the armature plate, is centered on the face end of the valve piston oriented toward the armature plate.

8. The injector as defined by claim 5, further includes a pressure rod having opposing ends, wherein the armature plate is operatively connected to the pressure rod at one end, and the other end of the pressure rod, remote from the armature plate, is centered on the face end of the valve piston oriented toward the armature plate.

9. The injector as defined by claim 6, further includes a pressure rod having opposing ends, wherein the armature plate is operatively connected to the pressure rod at one end, and the other end of the pressure rod, remote from the armature plate, is centered on the face end of the valve piston oriented toward the armature plate.

10. The injector as defined by claim 7, wherein centering of the pressure rod is attained by a concave-convex pairing between the valve piston and the pressure rod.

11. The injector as defined by claim 8, wherein centering of the pressure rod is attained by a concave-convex pairing between the valve piston and the pressure rod.

12. The injector as defined by claim 9, wherein centering of the pressure rod is attained by a concave-convex pairing between the valve piston and the pressure rod.

13. The injector as defined by claim 4 wherein a prestressing spring urges the armature plate by spring pressure in the direction of the valve piston, and the prestressing spring has a spring force that is less than a spring force of the spring inside the valve chamber.

14. The injector as defined by claim 7, wherein a prestressing spring urges the armature plate by spring pressure in the direction of the valve piston, and the prestressing spring has a spring force that is less than a spring force of the spring inside the valve chamber.

15. The injector as defined by claim 10, wherein a prestressing spring urges the armature plate by spring pressure in the direction of the valve piston, and the prestressing spring has a spring force that is less than a spring force of the spring inside the valve chamber.

16. The injector as defined by claim 7, wherein the electromagnet of the electromagnetic drive mechanism has a stop sleeve with a stop face for the armature plate received in a central through opening of the electromagnet, and the pressure rod is guided axially displaceably inside the stop sleeve.

17. The injector as defined by claim 10, wherein the electromagnet of the electromagnetic drive mechanism has a stop sleeve with a stop face for the armature plate received in a central through opening of the electromagnet, and the pressure rod is guided axially displaceably inside the stop sleeve.

18. The injector as defined by claim 13, wherein the electromagnet of the electromagnetic drive mechanism has a stop sleeve with a stop face for the armature plate received in a central through opening of the electromagnet, and the pressure rod is guided axially displaceably inside the stop sleeve.

19. The injector as defined by claim 1, wherein the throttle plate has a connecting conduit inside the throttle plate that is part of a connecting line which supplies the face end of the valve piston, remote from the valve seat, with low pressure, and causes the face end of the valve piston, remote from the valve seat, to communicate hydraulically with the low-pressure chamber and/or a return line.

20. The injector as defined by claim 1, wherein the other end of the spring is braced on an annular shoulder of the valve piston.

* * * * *